United States Patent [19]

Deutch

[11] Patent Number: 4,867,939

[45] Date of Patent: Sep. 19, 1989

[54] PROCESS FOR PREPARING ANTIHYDROGEN

[76] Inventor: Bernhard I. Deutch, c/o Institute of Physics, University of Aarhus, DK-8000 Aarhus C, Denmark

[21] Appl. No.: 34,311

[22] Filed: Apr. 3, 1987

[51] Int. Cl.[4] ..... G21C 1/02

[52] U.S. Cl. ..... 376/156; 376/913

[58] Field of Search ..... 376/156, 913

[56] References Cited

U.S. PATENT DOCUMENTS 4,341,731 7/1982 Mills, Jr. ..... 376/153
4,365,160 12/1982 Mills, Jr. ..... 376/913

OTHER PUBLICATIONS

Washington Daily News, (6/14/65), Report of Discovery of Anti-Hydrogen by Dr. Leon Lederman, p. 16.
Bull. Acad. Pol. Sci. Ser. Sci. Tech., (Poland), vol. 23, No. 10, 1975, Abstract, "Laser Anti-Hydrogen Micro Explosions", Kaliski.
Phy. Rev. A., vol. 11, No. 6, (6/75), Abstract, Kolos et al., "Hydrogen-Anti-Hydrogen Interactions".
Opto. Electron., vol. 5, No. 6, p. 491, Abstract, (11/73), Horq, "Estimates for . . . Production of Antihydrogen by Lasers . . . ".
AIP Conf. Proc., No. 145, (1986), Abstract, Workshop on Polarized Anti-Protons.
A.I.P. Conf. Pro., No. 128, p. 305, Abstract, (1985), Poth, Laser Application in Electron Cooling.
Phys. Rev. D., vol. 18, No. 5, p. 1602, Abstract, (9/1/78), Feinberg et al.
Phys. Rev. Lett., vol. 28, No. 19, p. 1227, Abstract, (5/8/72), Junkee et al., "Hydrogen-Antihydrogen Interactions".
Electronic & Atomic Collisions, p. 964, Abstract, (1971), Bardsley et al., "Hydrogen-Anti Hydrogen Collisions".
Astronautik, vol. 8, No. 2, p. 39, Abstract, (1971), Lob.
Phys. Rev. D., vol. 2, No. 8, p. 1389, Abstract, (10/15/70), Morgan et al., "Atomic Processes Involved in Matter-Antimatter Annihilation".
Collision, (Abstracts), p. 830, Abstract (8/69), MIT Press, Morgan et al., "Atom-Antiatom Collisions".
CERN-EP-86-105, CONF-8604201-6, Abstract, (4/10/86), Poth, "Antiprotonic, Hyperionic and Antihydrogen Atoms".
CERN-EP-86-10, CONF-8510263-3, (1/27/86), Abstract, Wolf et al., "Electron Cooling . . . and Production of Fast Anti-Atoms".
J. Phys. Soc. Jpn., vol. 55, p. 1136, Abstract, (1986 of Conf. of 8/85), Imai, "Meth. to Polarize Antiprotons through Antihydrogen Formation".
"Matter-Antimatter Molecules", Mattis, Phys. Rev. Lett. A, vol. 91A, No. 6, 287, 9/20/82, Abstract.
J. Phys. B. (U.K.), vol. 20:1, Jan. 14, 87, pp. 25-29, Humbertson et al., "On Anti-Hydrogen Formation with Positronium", Abstract.
B. I. Deutch et al., *Physica Scripta,* vol. T22, (1988), pp. 248-255.
J. W. Humberston et al., *J. Phys.,* B, (GB), 20, (1987), L25-29.
M. Charlton, "Antihydrogen".
J. H. McGuire et al., Phys. Rev. A, vol. 34, No. 1, (Jul. 1986), pp. 685-688.
R. L. Forward, *Mirror Matter—Pioneering Antimatter Physics,* John Wiley & Sons, New York, (1988), pp. 103-122.
S. Kaliski, Bull. DeL'Acad. Polonaise Des Sciences, vol. 23, (1975), pp. 99-100.

(List continued on next page.)

*Primary Examiner*—Salvatore Cangialosi
*Attorney, Agent, or Firm*—Paul & Paul

[57] ABSTRACT

A process for producing antihydrogen includes providing low energy antiprotons and positronium atoms within an interaction volume. Thermalized positrons are derived by moderating high energy positrons obtained from a high energy source, such as $^{22}Na$. The thermalized positrons are directed by electrostatic lenses to a positronium converter, positioned adjacent a low energy (less than about 50 KeV) circulating antiproton beam confined within an ion trap. Collisions between antiprotons and ortho-positronium atoms generate antihydrogen, a stable antimatter species, with substantial probability.

17 Claims, 2 Drawing Sheets

OTHER PUBLICATIONS

H. Hora, Opto-Electronics, 5, (1973), pp. 491-501.
G. Senjanovic, Proc. Neutrino Conf., Dept. Energy, BNL-32378, (1983), pp. 117-136.
H. Poth, Antimatter Physics at Low Energy, CERN--EP-86-105, (1986), pp. 325-345.
D. L. Morgan et al., Physical Rev. D., 2, (1970), pp. 1389-1399.
B. R. Junker et al., Phys. Rev. Lett, 28, (1972), pp. 1227-1229.
W. Kolos, Phys. Rev. A., 11, (1975), pp. 1792-1796.
A. Wolf et al., CERN-EP-86-10, (1986), pp. 78-91.
H. Lob, Astronautik, 8, (1971), pp. 39-46.
K. Imai, "A Method to Polarize Antiprotons . . . ", 6th Intl. Conf. Polar. Phen., (1985), p. 302.
G. Feinberg et al., Phys. Rev. D., 18, (1978), pp. 1602-1606.
H. Herr et al., Physics at LEAR with Low Energy Cooled Antiprotons, (1984), pp. 659-676.
W. J. Broad, New York Times, (Jan. 20, 1987), pp. Y15 et seq.
D. R. Bates et al., Proc. Roy. Soc. A, 267, (1962), 297-312.
D. R. Bates et al., Proc. Roy. Soc. A, 270, (1962), 155-163.
G. Gabrielse et al., Proc. Fermilab Workshop on Antimatter Physics at Low Energies, (1986), 211-226.
P. Lefevre et al., Proc. Fermilab Workshop on Antimatter Physics at Low Energies, (1986), 60-82.
R. E. Brown, 2nd Conference on the Interactions Between Particle and Nuclear Physics, (1986).
A. Wolf, "Antihydrogen", Eight European Symposium on Proton-Antiproton Interact., (Thessaloniki, Greece, 9/66).
J. M. Billen et al., Proc. Third LEAR Workshop, (Editions Frontieres Tigue, France), 107-113.
J. Humbertson, Advances in Atomic and Molecular Physics, 22, (1986), 1-36.
T. C. Griffith, Advances in Atomic and Molecular Physics, 22, (1986), 37-75.
V. M. Katkov et al., Sov. Phys. JEPT, 48(4), (1978), 639-643.
D. A. Church, J. App. Phys., 40, (1969), 3127.
A. P. Mills et al., Phys. Rev. B32, (1985), 53-57.
B. I. Deutch et al., Proc. Fermilab Workshop on Antimatter Physics at Low Energies, (1986), 379-91.
J. W. Humberston et al., J. Phys. B: At. Mol. Phys., 20, (1987), L25-29.
G. Gabrielse et al., Phys. Rev. Lett., 57, (1986), 2504-2507.
H. Poth, Proc. 2nd Conference on the Interactions Between Particle and Nuclear Physics, (1986).

PROCESS FOR PREPARING ANTIHYDROGEN

BACKGROUND OF THE INVENTION

1. Field of the Invention

This invention relates generally to atomic particle physics and specifically to a process and apparatus for the preparation of a stable antimatter element, and to the element itself. In particular, this invention relates to a process and apparatus for the preparation of antihydrogen.

2. Brief Description of the Prior Art

Antihydrogen is the simplest of the antimatter elements. It consists of a nucleus including a single antiproton nucleus enveloped by a single orbital positron. In contrast to exotic atomic species such as positronium and muonium, in the absence of reaction with normal matter, antihydrogen is a stable species having an indefinite half life.

It has been previously proposed that antihydrogen be formed at high laboratory energies by reaction of antiprotons and positrons at low relative center of mass energies, in analogy to the reaction of protons and electrons to form hydrogen. However, previously proposed processes are not expected to easily produce antihydrogen in sufficient densities that can be detected to permit measurement of its physical and chemical characteristics, or use as a probe in the analysis of the properties of other materials.

For example, it has been noted that the recombination of two charged particles, such as an antiproton and a positron, requires either a coupling to an electromagnetic radiation field, or the presence of a third massive particle to which energy and momentum can be transferred. However, at present anti-particle beams are only available at such low densities that the probability of antihydrogen formation through three-body interactions is negligible.

Alternatively, antihydrogen may be produced by recombination of antiprotons and positrons with simultaneous radiative emission. The cross-section for spontaneous radiative recapture can be enhanced by stimulating the emission, thus the use of a laser to stimulate recombination in overlapping beams of antiprotons and positrons has been proposed. However, under the proposed experimental conditions no more than 0.004 antihydrogen atoms per second are expected to be produced and at very high velocities. This makes detection of the antihydrogen problematic.

A number of measures have been proposed to increase the antihydrogen formation rate. For example it has been suggested that the positron beam be bunched and the phase of the beam be matched with applied laser pulses to maximize stimulated radiative recombination. Other measures proposed include increasing the positron beam intensity by recirculation of the positrons and improved positron moderation techniques.

An alternative to the cross-beam experiment is storing positrons and antiprotons simultaneously in an ion trap such as a quadrupole trap operated with an RF potential, and inducing reaction within the trap. At cryogenic temperatures (around 1° Kelvin) the spontaneous radiative recombination rate is high. On the other hand, at these low temperatures space-charge effects limit the stored particle density and consequently appear to limit the antihydrogen formation rate to about 10 per second. The particle trap makes antihydrogen atoms available at relatively low kinetic energies in the laboratory frame so that experiments relating to precise measurements of antihydrogen properties can be easily performed. But antihydrogen is expected to leave the quadrupole trap in arbitrary directions, unless the temperature can be reduced sufficiently so that the antihydrogen atoms can be trapped in magnetic field gradients acting on the positron magnetic moment. In contrast, the overlapping beam experiment is expected to produce a well-directed highly collimated antihydrogen atom beam. However, the antihydrogen atoms of the beam would have relatively high kinetic energy making precise measurements of the atomic properties of antihydrogen difficult.

Antihydrogen, the simplest antimatter element, is an extremely potent energy storage medium. Presently, the collision of antimatter particles with their corresponding normal matter particles (antiproton-proton) in cross-beam accelerators yield the highest levels of interaction energy obtainable (around 1.8 trillion electron volts, Tevatron accelerator, Fermi National Accelerator Laboratory). The interaction of hydrogen and antihydrogen is an important annihilation reaction of matter and antimatter at temperatures below $10^{5°}$ Kelvin.

Once the physical properties of antihydrogen itself have been measured and compared with those predicted by theory, it can be expected that antihydrogen will find significant use as a probe in the analysis of the properties of normal matter.

There is a need for a process for producing antihydrogen in detectable quantities at low energies, to permit study of the fundamental physical properties of antihydrogen itself, and to provide the antihydrogen as an analytical probe for the study of the properties of normal matter and for use as an energy storage medium.

SUMMARY OF THE INVENTION

The present invention is directed to providing a process and apparatus for the preparation of detectable amounts of antihydrogen. The process employs antiproton-positronium collisions to produce antihydrogen via Auger capture. The process comprises providing antiprotons and positronium within an interaction volume. Preferably, the positronium is provided by the interaction of a low-energy positron beam with a positronium converter positioned proximate or within the interaction volume. In one embodiment the positronium is generated proximate or within a storage ring containing a circulating antiproton beam. The storage ring can be a miniature version of CERN's LEAR facility.

In a presently preferred embodiment of the invention, circulating low-energy antiprotons are confined within an ion trap. A positronium converter, positioned within the ion trap, is bombarded by a low energy positron beam. The ion trap encloses the interaction volume for the positronium and the antiprotons. The ion trap can be a high-vacuum Penning or radiofrequency quadrupole ("REQ") trap, preferably an RFQ trap of racetrack design. Antiprotons obtained from a storage ring, such as the LEAR, are transferred to the ion trap. The average energy of antiprotons obtained from the storage ring, and the breadth of the momentum and energy distributions of the antiprotons, are reduced before the ion trap receives the antiprotons. It is preferred that the average energy of the antiprotons contained within the ion trap be less than about 50 KeV, preferably about 2.5 KeV. A well-collimated antihydrogen beam, having advantageously narrow energy and momentum distributions, is produced.

The low-energy positrons are preferably moderated from high-energy positrons and are directed as a beam to the converter electrostatically. In one embodiment of the present invention, it is preferred that the low energy positrons be generated in a field-assisted moderator.

Antihydrogen can be produced by the present process at substantially greater rates than by processes previously proposed. The antihydrogen so produced is available for use in analytical experiments, such as for the production of polarized antiprotons utilizing the hyperfine interaction in the antihydrogen atom. Both the polarized antiprotons and the antihydrogen itself can serve as important probes of material structure. Further, antihydrogen, by virtue of the annihilation reaction with hydrogen and other forms of normal matter, can be used as an energy storage medium.

Other objects and advantages of the present invention will become readily apparent to those skilled in the art from the following brief description of the drawings, the detailed description of the preferred embodiments, and the appended claims.

DETAILED DESCRIPTION

A key characteristic of any elementary particle-scattering process is the process cross-section. While cross-sections often can be measured experimentally for processes involving well-known and easily generated particles, cross-sections calculated from first principles are often very helpful in identifying appropriate experimental reaction conditions when novel processes and particles are involved.

The ground-state cross-section for the formation of antihydrogen in antiproton collisions with positronium has been calculated. The cross-section is given in FIG. 1 and at its maximum is about five orders of magnitude greater than that calculated for radiative capture to antihydrogen in antiproton-positron collisions, and about 1,000 times higher than the case in which a laser is used to stimulate the capture. While antihydrogen can in theory be produced by reaction of equal velocity beams of antiprotons and positrons circulating at high energy and velocity (such as within the LEAR), the antihydrogen produced would possess high average energy and low density, making use of the antihydrogen difficult.

The cross-section for the formation of antihydrogen in antiproton-positronium collisions is simply related to the cross-section for positronium formation in positron-hydrogen collisions. Reliable values for the cross-section for the formation of positronium in positron-hydrogen collisions have been calculated fo the Ore gap (6.8–10.2 e.V.) as well as at higher positron energies. The cross-section for antihydrogen formation from the collision of positronium and antiprotons is obtained by rescaling the cross-section calculated for positronium formation from positron-hydrogen collisions given that, by the principles of time reversal and invariance, the product of the positron wave number and the cross-section for positronium formation is equal to the product of the positronium wave number and the antihydrogen cross-section, and by the fact that energy conservation requires that the ratio of the square of the positron wave number minus one and the square of the positronium wave number minus one must be equal to one-half.

Figure 1:
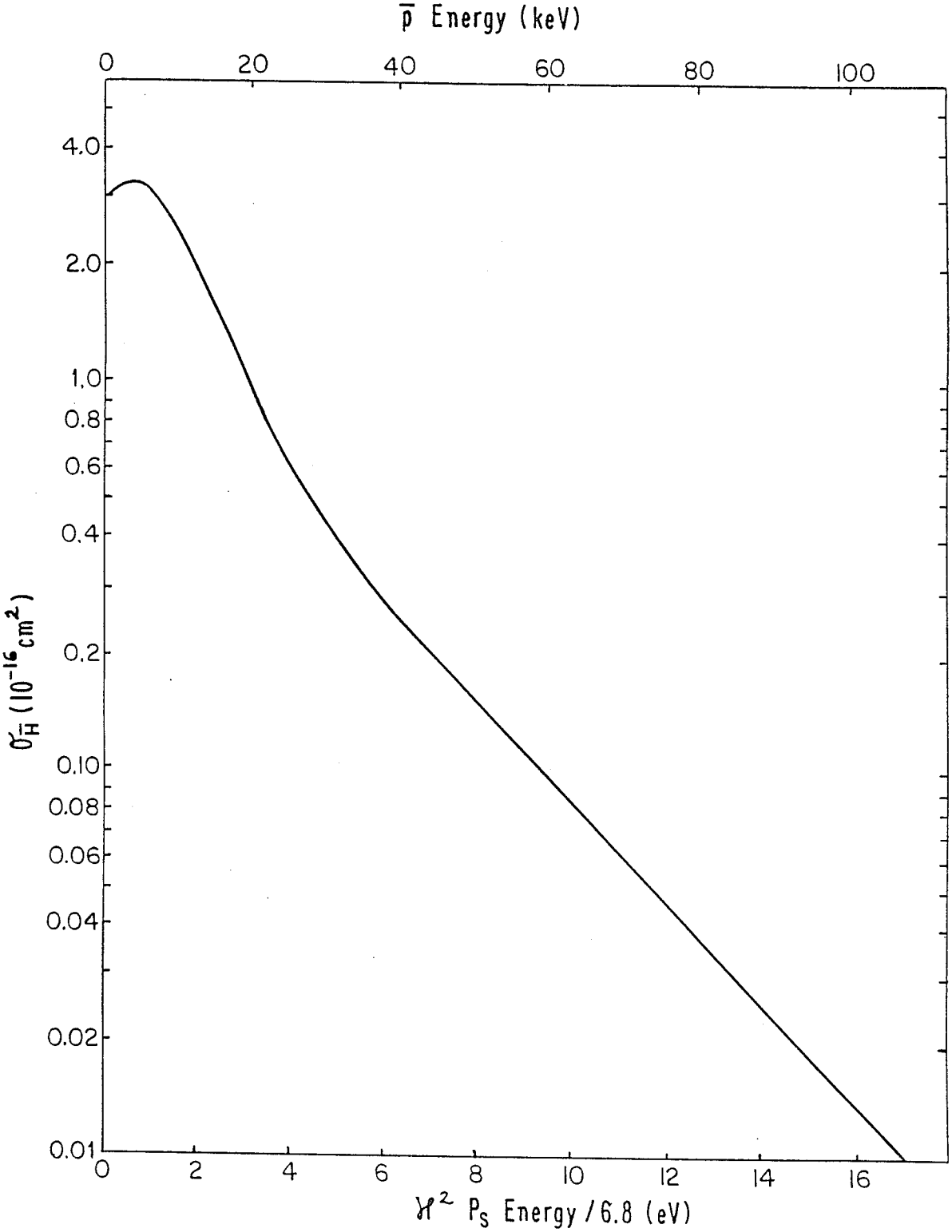
FIG. 1 is a graph illustrating the calculated cross-section from the production of antihydrogen by the present process as a function of energy.

FIG. 1 indicates that the antihydrogen formation cross-section has a broad maximum of about $3.2\times10^{-16}$ cm$^2$ at an antiproton energy of about 2.5 KeV (assuming a stationary positronium target in the lab frame of reference). In comparison, the cross-section for antiproton radiative capture, which is equal to those for the corresponding electron-proton process, has been indicated to be approximately $5\times10^{-20}$ cm$^2$ at a relative positron energy of only 0.1 eV. The antiproton energy corresponding to the cross-section maximum is significant because high intensity antiproton beams are readily available only at relatively high energies, and energy moderation necessarily attenuates the beam intensity. Thus, moderation of the antiproton beam to about 0.1 eV would require substantially greater attenuation than moderation to about 2 KeV. Further, the cross-section for radiative capture falls approximately linearly with increases in the positron energy. This necessitates the acceleration of the positron beam to the same velocity as the antiproton beam for maximum radiative capture cross-section with a small relative velocity spread (reducing the breadth of the velocity distribution is often referred to in the art as "cooling").

The relatively large calculated cross-section for antihydrogen formation from antiproton-positronium collisions indicates that antihydrogen can be produced experimentally by this process.

Figure 2:
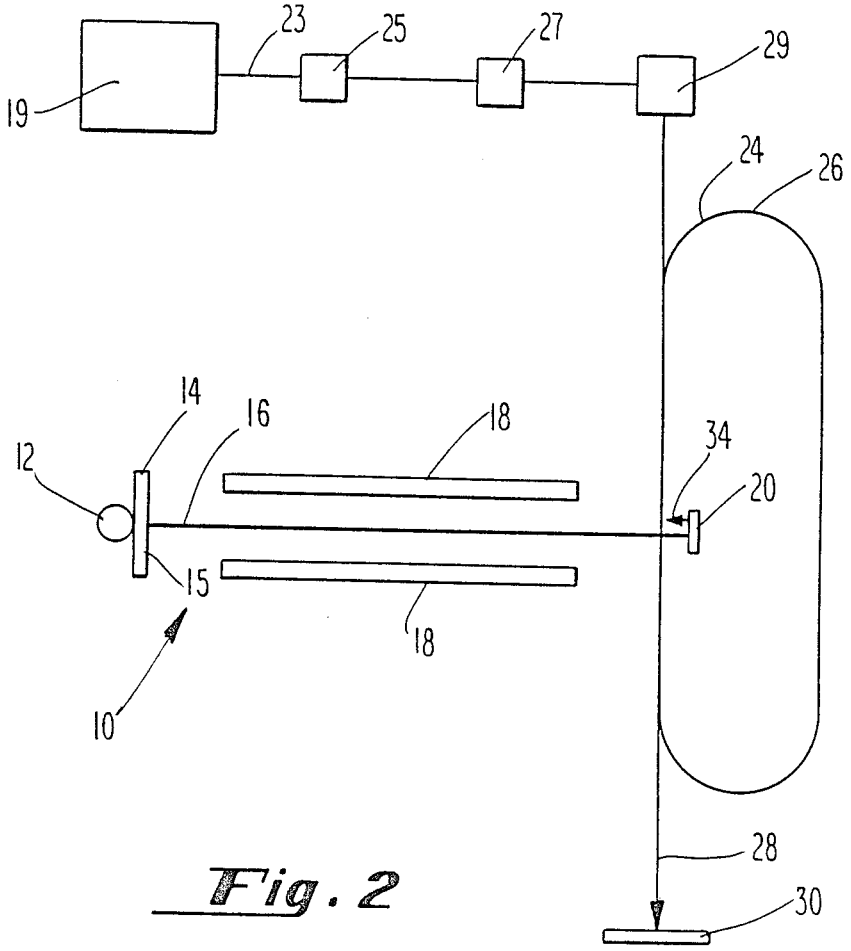
FIG. 2 is a schematic illustration of an apparatus for use in the process of the present invention for the production of antihydrogen.

FIG. 2 is a schematic illustration of an apparatus 10 employed to produce antihydrogen according to a presently preferred embodiment of the process of the present invention. A positron source 12 supplies high energy positrons. The high energy positrons can be delivered in the form of a high intensity focused positron beam, such as that generated by a LINAC, or they may be generated by the radioactive decay of a source such as $^{22}$Na, $^{81}$Rb, $^{64}$Cu, $^{58}$Co, or $^{59}$Fe. As is conventional, the high energy poistrons generated by the source 12 impinge upon a low energy moderator 14, e.g., a thin foil of a suitable metal such as copper or tungsten. Ultra-high vacuum conditions (less than $10^{-10}$ torr) are maintained within the apparatus 10 by such methods as are conventional in particle physics experiments in order to minimize collisions between residual gas molecules and the various particles and particle beams generated. Preferably, the source 12 is located far from the storage ring or ion trap containing antiprotons to minimize undesired interaction between particles generated by the source 12 and their progeny, and the antiprotons.

The low energy moderator 14 serves to lower and narrow the energy range of the positrons which are derived from the high energy positron source 12. Radioactive positron sources typically emit positrons over a broad energy range. The low energy moderator 14 serves to thermalize the positrons received from the high energy positron source 12 yielding positrons having a relatively narrow energy distribution on the order of thermal energies. Preferably, the low energy moderator 14 operates in a transition mode with high energy positrons impinging on a first surface and the thermalized positrons being ejected from an opposed parallel surface. Alternatively, the low energy moderator 14 can be of the backscattering type such as that disclosed in U.S. Pat. No. 4,341,731. If desired, the brightness of luminosity of the low energy positron beam can be enhanced by the technique disclosed in U.S. Pat. No. 4,365,160.

Another example of a slow positron moderator is a single crystal copper coated with a monolayer of sulphur which releases a slightly focused beam of $2.5\times10^6$ slow positrons per second at about one electron volt when bombarded with high energy positrons from a $^{58}$Co source. Higher fluxes of slow positrons can be produced by cascade positrons produced at the beam dump of an electronic accelerator or in pulse form.

Typically, after thermalization in the low energy moderator 14 positrons diffuse through the bulk and a fraction (about $10^{-3}$) of them reach the surface within their lifetime (100–200 picoseconds). The exit surface 15 of the low energy moderator 14 abuts a vacuum (not shown in FIG. 2) and the thermalized positrons are ejected into the vacuum with an energy of about one electron volt. Approximately $2\times10^7$ slow positrons per second can be produced using a 500 millicurie $^{22}$Na source and a tungsten moderator.

Preferably, an insulator is employed as a moderator and an electric field is applied thereto whereby the number of positrons which reach the surface is enhanced by several orders of magnitude because a net drift velocity is superposed onto their random thermal motion. It has been estimated that for a high purity silicon moderator as many as 10% of the fast positrons may be reemitted at low energies. This suggests that high intensity low energy positron beams can be produced using a radioactive source such as $^{22}$Na.

The low energy positrons emerging from the low energy moderator 14 are focused into a low energy positron beam 16 by electrostatic guide field lenses 18. The guide field lenses 18 include a transport lens (Enzel lens, no net acceleration or deceleration) followed by an acceleration lens (not shown). The guide field lenses 18 also serve to accelerate and deflect the low energy positron beam 16 as desired so that the positron beam 16 is directed to impinge upon the positronium converter 20. In the present embodiment, the positronium converter 20 is placed within a device 26 containing a low energy antiproton beam, such as a low energy storage ring, in which a beam of antiprotons circulates.

The low energy antiproton beam 23 is obtained from the LEAR or a similar device 19. The LEAR ("*Low Energy Antiproton Ring*"), located at CERN in Switzerland, stores a beam having an average momentum of about 0.1–1.7 GeV/c. The LEAR can supply bursts of about $10^7$ antiprotons at low energies (down to about 2 MeV). The LEAR stores antiprotons at high energies (relative to the KeV range) and low energy spread using bending magnets and electron cooling. The LEAR is not designed to operate at momenta below about 0.1 GeV/c at substantial beam currents. Design parameters such as the size of the beam bending magnets create this limit. The antiproton beam which typically circulates within the LEAR has substantially greater energy and momenta than that which are preferred for use in the present process. The average energy of the antiproton beam confined within the LEAR must be reduced before the antiprotons are supplied to an interaction volume for interaction with positronium. The antiproton beam containing device 26 can be a miniature version of the LEAR storage ring facility at CERN, or the like, provided the storage ring is designed to confine an antiproton beam having an appropriate energy and momentum range.

Deceleration and cooling of an antiproton beam 23 supplied, for example, by the LEAR or similar device 19, can be accomplished in several stages. The antiproton beam 23 can be decelerated to an average momentum on the order of 20 KeV employing a radiofrequency quadrople ("RFQ") 25. The beam 23 can be further conditioned to reduce the momentum spread of the beam by use of a debuncher 27, such as a double harmonic debuncher, or the like. The antiproton beam 23 can be further decelerated electrostatically (not shown). Subsequent to or concurrently with the electrostatic deceleration, the beam 23 is confined within an initial ion trap 29, such as a Penning trap. The initial ion trap 29 can employ electric and magnetic fields to confine the antiprotons. For example, a beam 23 originating from the LEAR 19 can be trapped within a Penning trap which is elongated in the beam direction and which has a strong (about 6 Telsa) magnetic field, such as can be produced by a superconducting solenoid (not shown), adapted to trap the antiprotons. A particle burst, or beam pulse 23, can be captured within the initial ion trap 29 by rapidly varying the potential of the electrodes (not shown) of the initial ion trap 29. After trapping the particles within the initial ion trap 29, the antiprotons' energy can be further reduced and the beam can be cooled. The antiproton energy can be reduced within the initial ion trap 29 to as low as about 50 eV, if desired. The initial ion trap 29 itself, or a portion thereof, can serve as an interaction volume for the antiprotons and positronium. However, the confined antiprotons are preferably transferred to an antiproton storage ring 26.

Alternatively, the average energy of an antiproton beam 23 delivered from the LEAR, or a similar device, can be reduced by momentum transfer through collision with the constituent atoms of a normal matter degrader (not shown), such as a beryllium foil window. While beam momentum can be substantially reduced using this approach, the attenuation of the beam is severe, with most collisions resulting in annihilation of the incident antiprotons. Preferably the momentum of the antiprotons in the antiproton beam is selected so that antihydrogen production is maximized. Preferably, the antiproton momentum is on the order of 0.014 $GeVc^{-1}$ and an energy of less than about 50 KeV.

The antiprotons are preferably stored in a storage ring 26, which is preferably an additional ion trap (FIG. 2), such as a racetrack trap in which a low energy antiproton beam 24 is confined in a transverse plane by radiofrequency focusing and the longitudinal motion of the antiprotons is confined to a closed path such as a circle or ellipse by quadrupole electrodes. A radiofrequency quadrople ion trap of racetrack design adapted to store protons is disclosed in D. A. Church, *J. App. Phys.* 40 (1969) 3127. The racetrack trap can be filled with antiprotons from a source such as the LEAR 19 at CERN through a RFQ decelerator 25 and an initial ion trap 29 adapted to serve as a cooled for the antiproton beam 23, such as discussed above. A single pulse of the LEAR can supply about $10^8$ antiprotons to this form of storage. As shown schematically in FIG. 3, the ion trap 26 can enclose the interaction volume for the low energy antiproton beam 24 and positronium.

Figure 3:
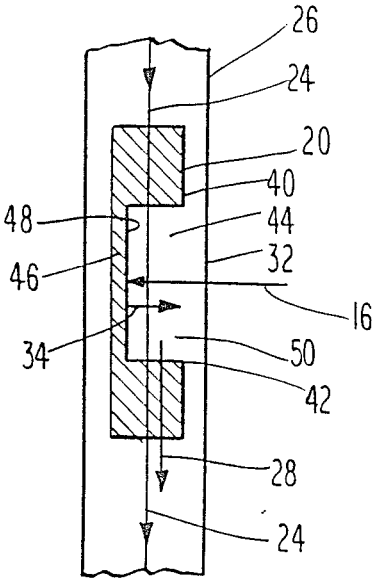
FIG. 3 is a schematic illustration of a portion of the apparatus of FIG. 2.

FIG. 3 schematically illustrates antihydrogen production occurring proximate the positronium converter 20. The positronium converter 20 is preferbly a small cylinder of single crystal Al(111) having an exterior surface 40, a diameter of about one centimeter and a length of a few centimeters, and oriented with the (111) crystallographic plane of the aluminum perpendicular to the incident positron beam 16. A small aperture 42 is bored or formed in the surface 40 of the cylinder to give a bore 44 with a wall 46 having a generally planar interior surface 48 which parallels the longitudinal axis of the cylindrical converter 20. The interior surface 48 is oxidized to give a thin coating of aluminum oxide. The positronium converter 20 is placed into the antiproton beam storage device 26 with the long axis of the positronium converter 20 coincident with that of the circulating low energy antiproton beam 24. The low energy positron beam 16 enters the storage device 26 through an aperture 32. Subsequently, the low energy positron beam 16 enters the cylindrical positronium converter 20 through the aperture 42 and impinges on the interior surface 48 of the wall 46. The coincidence of the antiproton beam 24 and the bore 44 defines an interaction volume or zone 50.

The positron energy is selected to be about 25 eV so that between 50 and 100% (depending on the temperature of the positronium converter 20) of the positrons diffuse back to the interior surface 48, where they are ejected into the vacuum in a positronium state with energies ranging from a few meV to about 2.6 eV, with the energy distribution peaked toward the lower end of this range. A. P. Mills et al., *Phys. Rev. B* 32 (1985) 53–57.

The positronium 34 ejected from the surface 48 is either para-positronium (intrinsic lifetime 0.125 nanoseconds) or ortho-positronium (mean vacuum lifetime 142 nanoseconds). Spin statistics require that ortho- and para-positronium be produced in a three-to-one ratio. Thus, ortho-positronium atoms are produced under these conditions at an average density of about 100 $cm^{-2}$ as seen by the low energy antiproton beam 24.

A radiofrequency quadrupole ion trap of racetrack design, a type of antiproton storage ring 26, can capture and store at least about $10^8$ antiprotons with an energy $\leqq$2–5 KeV, decelerated from the LEAR 19 through an RFQ decelerator 25 and cooled in the initial ion trap 29. The antiproton beam 24 stored within such an RFQ ion trap can have a beam cross-section 0.2 cm square, traversing a path length of about 25 cm, with a ratio of transverse to longitudinal momenta of less than about 1/100. Momentum conservation requires that the emission of antihydrogen from the interaction zone 50 will be as highly collimated antihydrogen beam 28 parallelling the incident low energy antiproton beam 24. The antihydrogen beam 28 is composed of a neutral species, and can escape the storage ring 26 through an exit port (not shown). The antihydrogen beam 28 can be directed to impinge upon an appropriate target 30 (FIG. 2) for experimentation, or the antihydrogen beam 28 can be directed to an appropriate storage device for antihydrogen (not illustrated). A laser beam (not shown) collinear with the antihydrogen beam 28 can be applied for spectroscopic characterization of antihydrogen. Emission from excited atomic states of antihydrogen is also expected, and the excited state emission can also be used for characterization.

In the present embodiment of the process of the invention, a radiofrequency quadrople ion trap of racetrack design is substituted for a miniaturized LEAR-type storage ring or similar device. It is estimated that with (i) 50% efficient positronium conversion, (ii) a 0.4 cm diameter positronium converter positioned within a 5 cm diameter racetrack ion trap filled with $10^8$ antiprotons, (iii) tungsten single crystal posistron moderation of a one Curie $^{22}Na$ source, a collimated antihydrogen beam 28 of four antihydrogen atoms per second is produced.

Figure 4:
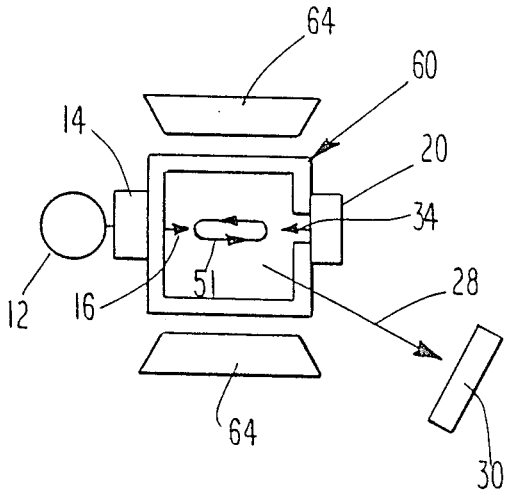
FIG. 4 is a schematic illustration of another apparatus for use in the process of the present invention.

In another embodiment, circulating antiprotons are confined within a volume in another type of storage device 60 (FIG. 4) which is not a storage ring. The antiproton storage device 60 can be a Penning trap or the like which confined charged particles by application of both electric and magnetic fields by means of electrodes 64 and magnets (not shown) positioned proximate the storage device 60. Preferably, the storage device 60 has a volume of about one cubic centimeter.

In this additional embodiment, the antiprotons are confined to circulate in a generally circular beam 51 defining a relatively small area on the same order of magnitude as the dimensions of the positronium beam 34. As in the previously described embodiments, antihydrogen 28 is formed by the interaction of a positronium beam 34, generated from interaction of a low energy positron beam 16 with a converter 20, with the antiproton beam 51. The antiprotons 51 are supplied by means of a LEAR or similar device (not shown). The antihydrogen produced in this embodiment is not collimated and colinear with the incident antiproton beam, as is the case in the previously described embodiment employing an antiproton beam circulating in a storage ring 26 (FIG. 2) such as a miniature LEAR or a racetrap ion trap.

Preferably, the antiproton densities in the storage device 60 are in the range of $10^4$–$10^8$ $cm^{-3}$ and residual gas pressures less than about $10^{-12}$ torr are maintained by conventional high vacuum techniques and apparatus (not shown). It is also preferable that the electrodes 64 be meshed so that the storage device 60 is transparent to annihilation radiation and antihydrogen emission which are no longer colinear. The source 12, moderator 14, and positronium convertor 20 are positioned as in the embodiment described above which employs an antiproton storage ring, with the source 12 being placed far enough away from the trap 60 so that there is no deterioration of the necessary vacuum conditions which are maintained within the storage device 60. The geomertry of the storage device 60 and the target 30 or the detection equipment (not shown) for measurement is determined by the velocity of the antihydrogen produced as well as by the velocities and lifetimes of the beams necessary for production of the antihydrogen. Although antiproton motion is no longer confined within a well-collimated beam, and the emitted antiydrogen atoms are no longer colinear, antihydrogen may be emitted at an enhanced rate.

Numerous modifications and variations of the present process will be understood to be within the purview of the present invention as defined by the appended claims by those skilled in the art. For example, those skilled in the art will understand that more intense antihydrogen beams can be produced by the present process when crossed beams of positronium and antiprotons having sufficiently great intensities and densities are employed through enhanced moderator efficiencies, and enhanced positron and antiproton sources.

I claim:

1. A process for producing antihydrogen from antiproton-positronium collisons via Auger capture, the process comprising providing antiprotons having an average energy of less than about 50 KeV and positronium having an average energy on the order of thermal energies within an interaction volume.

2. A process according to claim 1 wherein the antiprotons circulate within a storage ring.

3. A process according to claim 2 wherein the antiprotons circulate as a beam within a first ion trap.

4. A process according to claim 3 wherein antiprotons which circulate within a storage ring are transferred to the first ion trap, the average energy and momentum of the antiprotons being reduced during the transfer.

5. A process according to claim 4 wherein a radiofrequency quadrupole is employed to reduce the average energy of the antiprotons during the transfer of the antiprotons from the storage ring to the first ion trap.

6. A process according to claim 5 wherein the antiprotons are confined to circulate in a second ion trap after transfer from the storage ring and before transfer to the first ion trap, the antiprotons being cooled within the second ion trap.

7. A process according to claim 4 wherein the first ion trap is selected from Penning traps and radiofrequency quadrupole traps.

8. A process according to claim 3 wherein the average energy of the antiprotons contained within the first ion trap is less than about 50 KeV.

9. A process according to claim 8 wherein the average energy of the antiprotons is about 2.5 KeV.

10. a process according to claim 1 wherein the antiprotons have an average momentum of less than about 0.02 $beVc^{-1}$.

11. A process according to claim 1 wherein the positronium is provided by the interaction of a positron beam with a converter.

12. A process according to claim 11 wherein the thermalized positron beam is formed by bombardment of a moderator with positrons obtained from a radioactive source.

13. A process according to claim 12 wherein the radioactive source is $^{22}Na$.

14. A process according to claim 12 wherein the moderator includes a metal selected from aluminum, copper, and tungsten.

15. A process according to claim 12 wherein the moderator is an insulator and an electric field is applied to the moderator to superpose a net drift velocity on the positrons formed therein.

16. A process according to claim 11 wherein the converter is positioned proximate the interaction volume.

17. A process according to claim 16 wherein the converter includes Al(111) and has an aluminum oxide surface, the (111) plane being oriented perpendicular to the incident positron beam.

* * * * *